United States Patent [19]

Bishop

[11] 4,256,416

[45] Mar. 17, 1981

[54] SCREED FOR LEVELING FRESHLY POURED CONCRETE

[76] Inventor: Roy I. Bishop, 5140 Yelm Hwy., Olympia, Wash. 98503

[21] Appl. No.: 38,410

[22] Filed: May 14, 1979

[51] Int. Cl.[3] ..... E01C 19/22

[52] U.S. Cl. ..... 404/119

[58] Field of Search ..... 404/118, 114, 101, 119, 404/120, 97

[56] References Cited

U.S. PATENT DOCUMENTS

| | | | |
|---|---|---|---|
| 653,795 | 7/1900 | Ecke . | |
| 867,852 | 10/1907 | Switzer . | |
| 1,220,986 | 3/1917 | Henderson | 404/118 |
| 1,234,984 | 7/1917 | Walker . | |
| 2,141,301 | 12/1938 | Jackson | 404/114 |
| 2,155,571 | 4/1939 | Tullis . | |
| 2,306,126 | 12/1942 | Jackson | 404/114 |
| 2,371,290 | 3/1945 | Heltzel | 404/74 |
| 2,584,459 | 2/1952 | Jackson | 404/114 |
| 2,599,330 | 6/1952 | Jackson | 404/114 |
| 2,693,136 | 11/1954 | Barnes | 404/114 |
| 3,046,856 | 7/1962 | Baxter . | |
| 3,095,789 | 7/1963 | Melvin | 404/114 |
| 3,681,484 | 8/1972 | McKie | 404/114 X |

FOREIGN PATENT DOCUMENTS

| | | | |
|---|---|---|---|
| 585306 | 2/1947 | United Kingdom | 404/114 |
| 610568 | 10/1948 | United Kingdom | 404/114 |

*Primary Examiner*—Nile C. Byers, Jr.

*Attorney, Agent, or Firm*—Eugene D. Farley

[57] ABSTRACT

A screed for leveling freshly poured concrete comprises a pair of handle assemblies each comprising a body, a first handle extending upwardly from the body, a second handle extending laterally outwardly and upwardly from the body, and a leveling bar, such as a length of lumber, releasably attached at its ends to the respective handle assemblies.

2 Claims, 4 Drawing Figures

SCREED FOR LEVELING FRESHLY POURED CONCRETE

BACKGROUND AND GENERAL STATEMENT OF THE INVENTION

This invention relates to devices ("screeds") for leveling freshly poured concrete.

After concrete has been poured into horizontal forms, it is conventional practice to smooth its surface in order to level it and remove surface imperfections. This may be done manually using a length of lumber drawn across the surface, or by the use of more sophisticated mechanical devices.

It is the general purpose of the present invention to provide a manually operated screed comprising a levelling bar having a pair of removable handles at its ends, and characterized by the following advantages:

(1) Easily stored and transported, since only the handles need be retained and carried from place to place.

(2) Easily and rapidly assembled and disassembled using a piece of 2×4 or 2×6 available at the work site.

(3) Easy and safe to use, since the workmen can stand while using it and use the handles as levers with which to manipulate it.

(4) Adaptable for secondary use as a barricade to protect the newly poured and smoothed concrete.

(5) Simply and inexpensively made.

The screed of my invention providing the foregoing and other advantages basically comprises a pair of handle assemblies and a leveling bar to the ends of which the handle assemblies are releasably attached.

Each handle assembly comprises a body, a first handle extending upwardly from the body, and a second handle extending laterally and outwardly from the body at a predetermined angle. Releasable attaching means, for example nail and socket attaching means, attach the handles to the respective ends of the bar.

In use, the operators grasp the handles and, while standing, work the bar across the surface of the soft concrete, using the handles to manipulate the bar as required to accomplish the desired finishing function. When the task has been completed, the handles may be removed from the bar and stored pending another use.

DESCRIPTION OF A SPECIFIC EMBODIMENT OF THE INVENTION

The specific embodiment of the invention is described in conjunction with the accompanying drawings, wherein.

As indicated above, the hereindescribed concrete leveling screed basically comprises a levelling bar such as a length of lumber or other structural material having a pair of handle assemblies releasably attached to its ends.

the lumber length 10 preferably comprises a piece of 2×4 or 2×6 of suitable length such as is conveniently available at any construction site. Accordingly, only the handle assemblies need be stored and transported from site to site.

Each handle assembly comprises a body, an upwardly extending handle, a laterally and outwardly extending handle, and releasable attaching means for attaching the handle assembly to one of the ends of the lumber piece.

Figure 1:
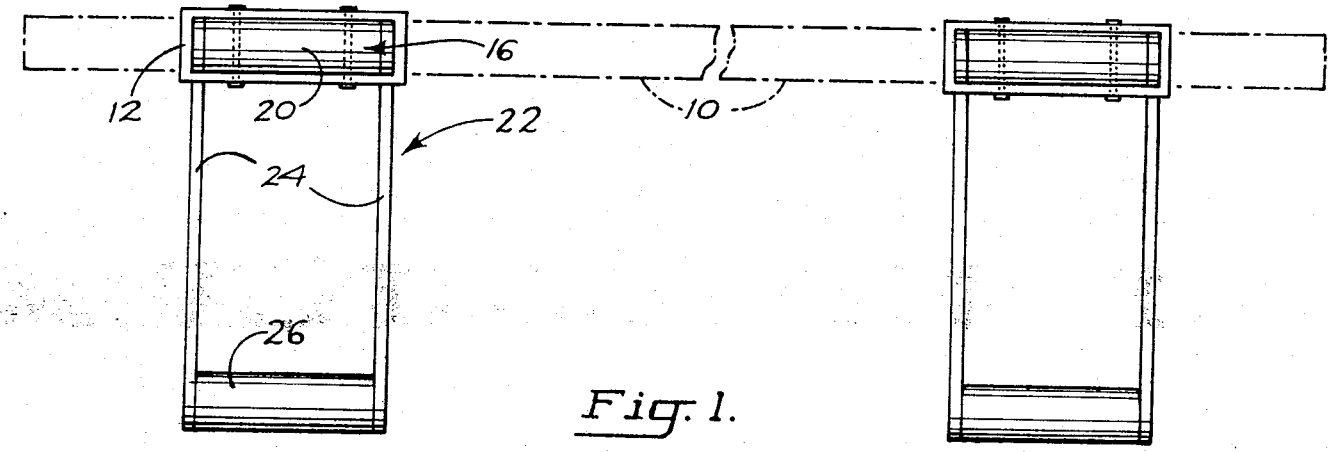
FIG. 1 is a top plan view of the screed of my invention.
Figure 2:
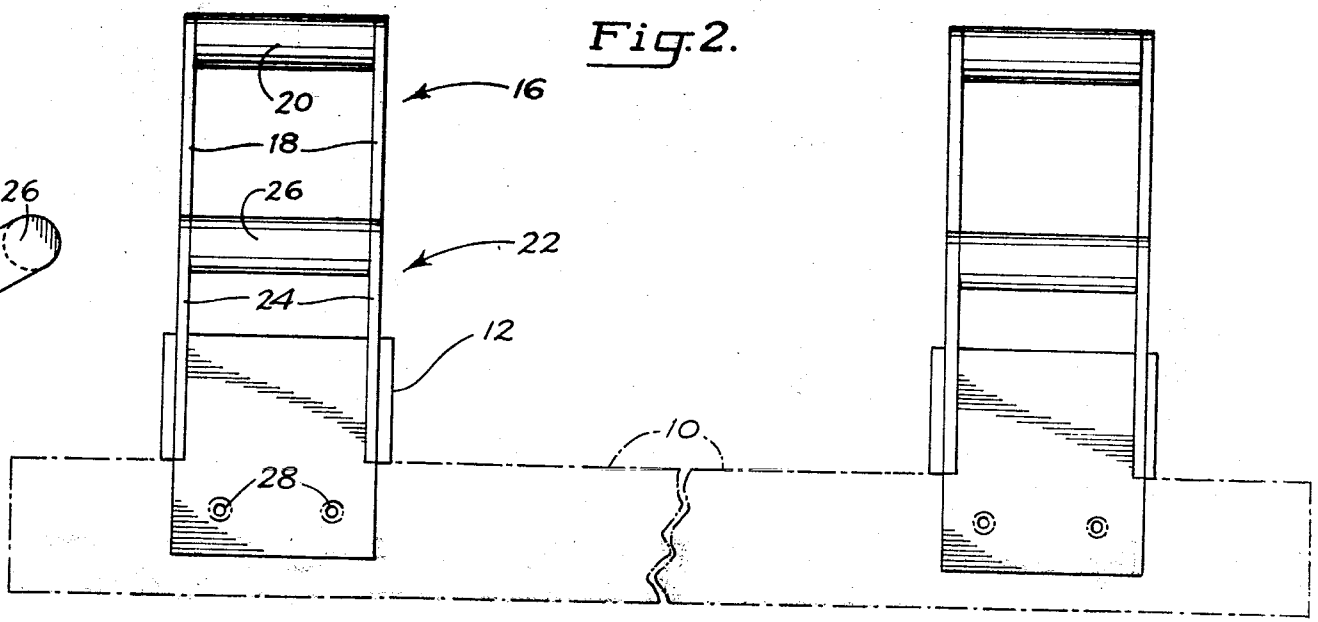
FIG. 2 is a foreshortened view in side elevation thereof.
Figure 3:
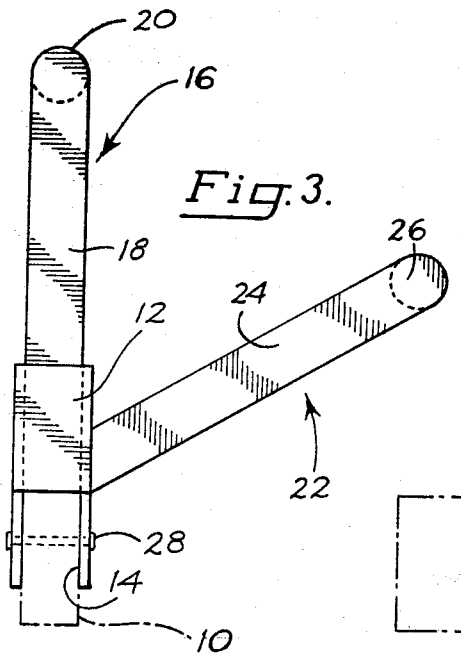
FIG. 3 is an end view thereof.

The body 12 comprises a vertically arranged tube of rectangular cross section. Opposite end walls of the lower portion of the tube are cut away, as illustrated in FIG. 3, to form a socket 14 dimensioned to receive an end of lumber piece 10. The upper end of the tube is open.

A first handle indicated generally at 16 extends upwardly from body 12.

The handle comprises a pair of side pieces 18 of flat bar stock which extend downwardly into the interior of body 12 and are welded to the upper portions of the end walls thereof. A cross piece 20, preferably a corrugated metal tube, interconnects the upper ends of the bars.

A similarly constructed handle, indicated generally at 22 extends laterally outwardly and slightly upwardly from body 12.

This handle comprises a pair of flat bars 24 welded at their inner ends to a side face of body 12. The bars extend laterally outwardly and upwardly at an angle of preferably about 60°.

Handle 22 is disposed substantially normal to lumber piece 10. A grip 26, which preferably comprises a piece of corrugated tubing, is welded between the outer ends of bars 24 of the handle.

The means provided for releasably attaching the respective ends of lumber piece 10 to the handle assemblies comprise spur type fasteners such as nails 28 which may be driven through openings in the sides of body 12 and into the lumber piece.

In the use of the screed of my invention, the handle assemblies only may be carried to the construction site. They are placed over the ends of lumber piece 10 with the latter received in sockets 14. Thus mounted, they are releasably secured by means of nails 28.

Figure 4:
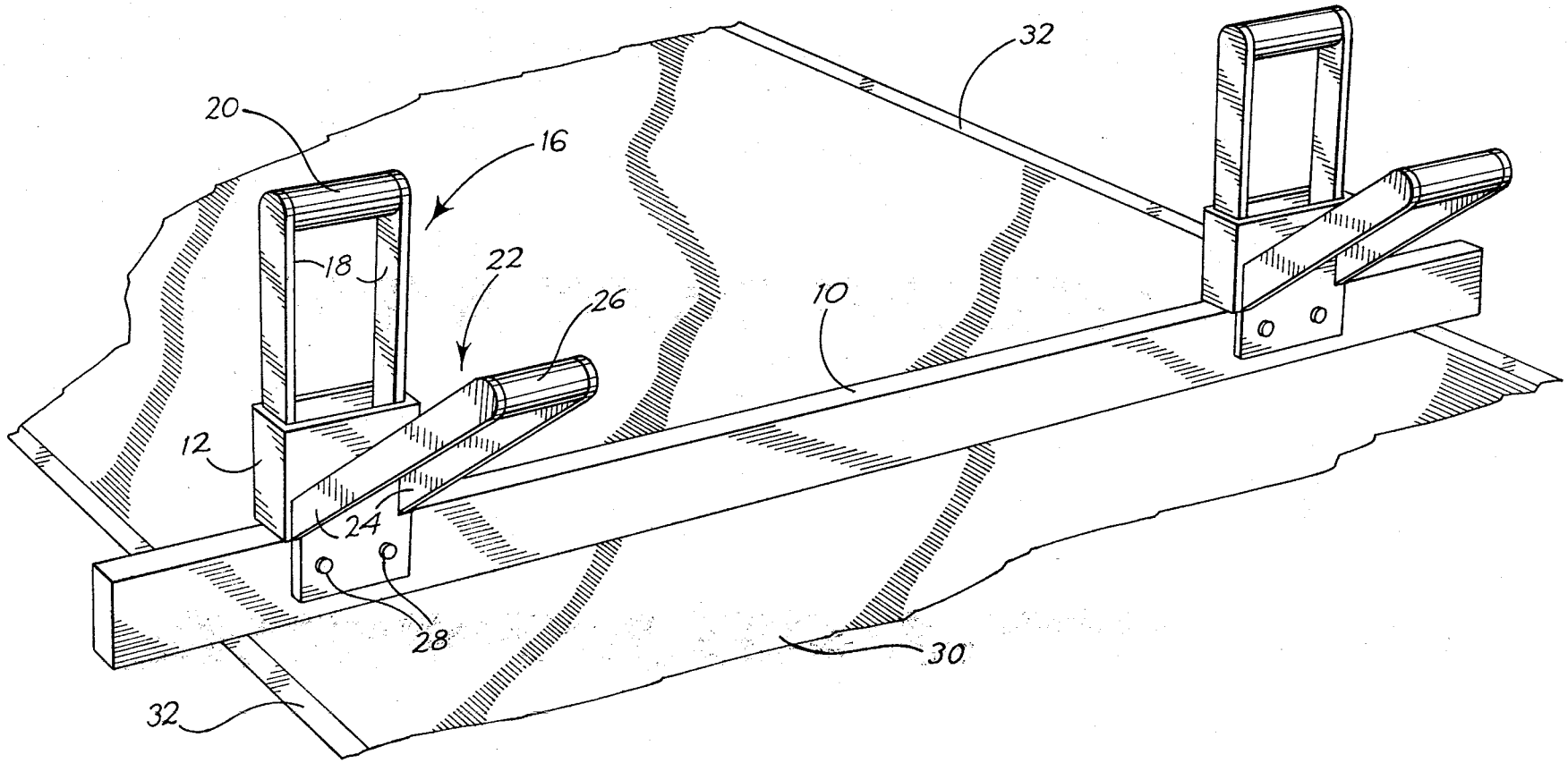
FIG. 4 is a top perspective view, illustrating the manner of use of the screed of my invention.

An operator is stationed at each end of the resulting screed assembly. The operators grasp the handles with both hands and work the screed across the surface of the freshly poured concrete 30 in the manner particularly apparent in FIG. 4. If the concrete is poured between retaining forms 32, the apparatus is drawn across its upper surface with the lower edge of leveling bar 10 resting on the upper surfaces of the forms. However, if such forms are not present, the screed may be worked across the surface of the concrete in self-evident manner.

During the leveling operation, the operators can stand in a substantially upright position, because of the length of handles 16, 22. Also, they can manipulate the screed easily and accurately because of the leverage afforded by the handles. Still further, after the leveling operation is complete, the screed assembly may be placed upside down in front of or over the freshly poured and smoothed surface, where it serves as a practical and efficient barricade. When its use has been completed, it may be disassembled simply by withdrawing nails 28 and the handle assemblies carried to the next construction site.

Having thus described my invention in preferred embodiment, I claim as new and desire to protect by Letters Patent:

1. A screed for leveling freshly poured concrete, comprising:

(a) an elongated leveling bar, and (b) a pair of handle assemblies secured releasably to the leveling bar one adjacent each end of the latter, each handle assembly comprising:

(1) a body secured releasably to the leveling bar, (2) a first handle secured to the body and extending vertically upward from the leveling bar, and (3) a second handle secured to the body and extending laterally and upwardly from the levelling bar.

2. The screed of claim 1 wherein the leveling bar is of rectangular cross section and the body includes a pair of downwardly extending plates spaced apart substantially the width of the leveling bar receiving the latter freely therebetween, the plates having transverse openings therethrough for receiving spur type fasteners for securing the body to the leveling bar.

* * * * *